US009173511B2

(12) United States Patent
Kasha

(10) Patent No.: US 9,173,511 B2
(45) Date of Patent: Nov. 3, 2015

(54) DOUBLE-WALLED VASE FOR RECEIVING DECORATIVE FILLER MATERIALS

(71) Applicant: Adam Kasha, Ann Arbor, MI (US)

(72) Inventor: Adam Kasha, Ann Arbor, MI (US)

( * ) Notice: Subject to any disclaimer, the term of this patent is extended or adjusted under 35 U.S.C. 154(b) by 0 days.

(21) Appl. No.: 14/265,675

(22) Filed: Apr. 30, 2014

(65) Prior Publication Data

US 2015/0144638 A1 May 28, 2015

Related U.S. Application Data

(60) Provisional application No. 61/907,711, filed on Nov. 22, 2013.

(51) Int. Cl.

| | |
|---|---|
| ***A47G 7/06*** | (2006.01) |
| ***B65D 13/02*** | (2006.01) |
| *B65D 39/04* | (2006.01) |
| *B65D 1/20* | (2006.01) |

(52) U.S. Cl.

CPC ... *A47G 7/06* (2013.01); *B65D 1/20* (2013.01); *B65D 13/02* (2013.01); *B65D 39/04* (2013.01)

(58) Field of Classification Search

CPC ..... A47G 7/06; A47G 7/02; B65D 7/22; B65D 9/26; B65D 11/16; B65D 1/20; B65D 39/04; B65D 25/54; B65D 13/02; B65D 1/04; B65D 1/06; B65D 21/0233

USPC ..... 220/62.15, 62.18, 62.11, 602, 601, 665, 220/662; 47/41.01; 215/6, 10

See application file for complete search history.

(56) References Cited

U.S. PATENT DOCUMENTS

| | | | | |
|---|---|---|---|---|
| 53,279 | A | 3/1866 | Dithridge | |
| 116,401 | A | 6/1871 | Bingham et al. | |
| 650,614 | A | 5/1900 | Roeseler | |
| 1,393,235 | A * | 10/1921 | Mitrovich | 215/6 |
| 2,029,314 | A | 2/1936 | Ellis | |
| 4,017,729 | A | 4/1977 | Frazier, Jr. | |
| 4,065,016 | A | 12/1977 | Perkins | |
| 4,525,950 | A | 7/1985 | Glassman | |
| 4,941,590 | A * | 7/1990 | Pantaleo et al. | 220/662 |
| 5,047,268 | A | 9/1991 | Cheng | |
| 7,082,714 | B1 | 8/2006 | Behrens | |
| 7,104,413 | B2 * | 9/2006 | Liu | 215/12.1 |

(Continued)

FOREIGN PATENT DOCUMENTS

| | | |
|---|---|---|
| CN | 2310748 | 3/1999 |
| DE | 102005011187 | 9/2006 |

(Continued)

*Primary Examiner* — Robert J Hicks

(74) *Attorney, Agent, or Firm* — Dinsmore & Shohl LLP

(57) ABSTRACT

Double-walled decorative articles such as flower vases and candle holders comprise an inner form defining a receptacle and an outer form, spaced apart from the inner form, to create a cavity. A bottom opening in the outer form enables decorative filler materials to be introduced to the cavity such that the decorative materials do not enter into the receptacle, which may contains flowers, water, candles, hot wax or other substances. A removably replaceable plug or cap is used to close off the bottom opening following the introduction of the decorative filler materials. The inner and outer forms may be provided as a unitary item or separate pieces may be joined. The decorative filler materials may be provided in conjunction with the article as part of a kit, in which case the amount of filler material is matched to the volume of the cavity.

7 Claims, 25 Drawing Sheets

(56) References Cited

U.S. PATENT DOCUMENTS

| | | | |
|---|---|---|---|
| D630,124 | S | 1/2011 | Connell et al. |
| 8,033,412 | B2 | 10/2011 | Mayo |
| 2010/0308061 | A1 | 12/2010 | Loulourgas |

FOREIGN PATENT DOCUMENTS

| | | |
|---|---|---|
| DE | 202007007802 | 11/2007 |
| EP | 0978233 | 2/2000 |

* cited by examiner

CAP

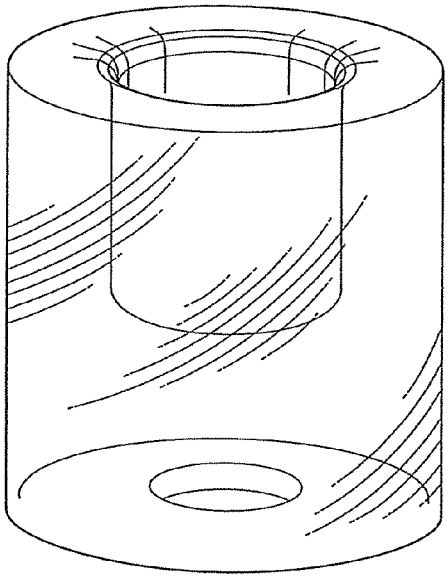
Fig-10B
Fig-10C
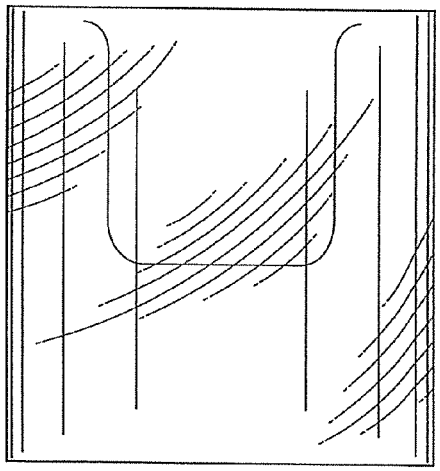

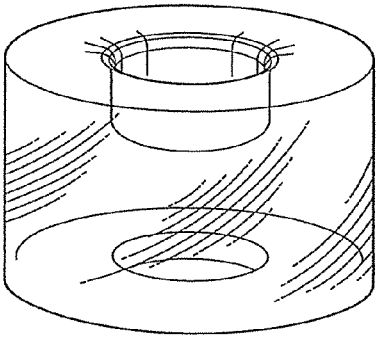
FIG. 11B
Fig-11C
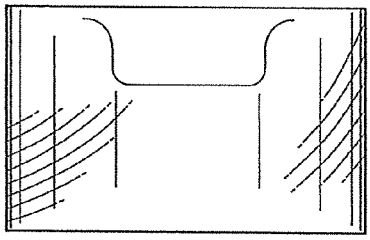
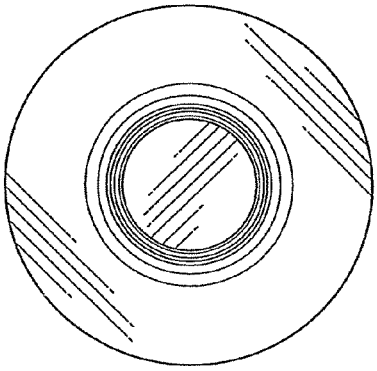
Fig-11D
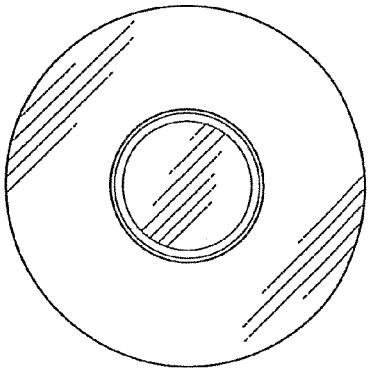
Fig-11E

DOUBLE-WALLED VASE FOR RECEIVING DECORATIVE FILLER MATERIALS

REFERENCE TO RELATED APPLICATION

This application claims priority from U.S. Provisional Patent Application Ser. No. 61/907,711, filed Nov. 22, 2013, the entire content of which is incorporated herein by reference.

FIELD OF THE INVENTION

This invention relates generally to vases, candleholders, and like articles and, in particular, to double-walled articles configured to receive decorative filler materials.

BACKGROUND OF THE INVENTION

Double-walled vessels have been in existence for many years for various purposes. U.S. Pat. No. 116,401, for example, provides a vase which can be supplied with water by its own action after the reservoir is once filled, and thus save much trouble and time now required to take care of plants in vases used to decorate cemetery lots or other places remote from the residence of the owner. To accomplish this goal, a vase or flower-pot has double walls providing a reservoir for water or air, and the necessary pipes, for the purposes specified.

U.S. Pat. No. 650,614 relates to flower pots and vases and the like; and it consists in providing these receptacles with double walls inclosing a stagnant layer of air and in providing the bottoms of the same with inwardly and upwardly extending tubes or pipes instead of the ordinary orifices generally employed. The pot or vase is provided with double walls, closed at the top by an annular ring, and open at the bottom, which closes up the inner wall only. The effect produced by the double-walled pot is that the roots of the plants therein will not be subjected to sudden changes of temperature, because the stagnant layer of air within the walls constitutes a poor conductor of heat, and thus compensates for sudden temperature changes.

U.S. Pat. No. 4,065,016 discloses a compound vessel formed of a transparent material having a spheroidal main body. The main body is comprised of spheroidal inner and outer walls with an annular space defined therebetween. The annular space constitutes an outer vessel of the compound vessel and the space contained by the inner wall constitutes an inner vessel of the compound vessel. The outer and inner walls join at one extremity of the spheroidal main body of the compound vessel to close the outer vessel and form the periphery of a generally circular mouth opening into the inner vessel, the inner vessel being otherwise closed. The outer wall terminates at an opposite extremity of the spheroidal main body of the compound vessel to form the periphery of a generally circular mouth opening into the outer vessel, the outer vessel being otherwise closed.

U.S. Pat. No. 4,525,950 describes a receptacle usable as a flower vase, and especially adapted to present the illusion of being filled with a liquid to a level called the "illusion line." The vase has an inner tubular insert sealed to an outer receptacle at the common rim of the outer receptacle and tubular insert. The outer receptacle and tubular insert define between them a cavity or space which can be filled with a transparent fluid. In use, artificial flowers or any decorative material that one might wish to store dry can be placed within the inner tubular insert, and the liquid within the cavity will present the illusion of the receptacle being completely filled with liquid, and the decorative material being immersed in this liquid.

According to U.S. Pat. No. 7,082,714, a vessel provides a decorative display of a floral arrangement or like items utilizing a reservoir of liquid for providing visual effects, with the items placed within the reservoir and extending upwardly out of the reservoir, and a light source within an inner chamber surrounded by the reservoir, the walls of the reservoir being light-transmitting and the inner chamber being flared radially outwardly and upwardly to dissipate heat from the light source and to deflect the items radially outwardly away from the heat emanating from the light source.

In U.S. Pat. No. 8,033,412, a double-walled drinking vessel, e.g., a tumbler, is described that is constructed of a downwardly tapered outer wall with a bottom and a continuous side wall with an upper rim; an inner wall with a bottom and a continuous side wall with an upper rim, the inner wall being spaced inwardly from the outer wall and including a first downwardly tapered section extending downwardly from the rim, a second downwardly tapered section extending upwardly from the bottom, and a continuous cylindrical section of a given height and diameter between the first and second tapered sections; and a decorative fabric band secured around the cylindrical section, the band having a width approximately equal to the width of the cylindrical section and a length at least as great as the diameter of the cylindrical band.

SUMMARY OF THE INVENTION

This invention resides in double-walled decorative articles such as flower vases and candle holders. Such articles comprise an inner form defining a receptacle and an outer form, spaced apart from the inner form, to create a cavity. A bottom opening in the outer form enables decorative filler materials to be introduced to the cavity such that the decorative materials do not enter into the receptacle, which may contains flowers, water, candles, hot wax or other substances. A removably replaceable plug or cap is used to close off the bottom opening following the introduction of the decorative filler materials.

The inner and outer forms may be provided as a unitary item or separate pieces may be joined. The inner and outer forms may be made of glass, plastic or other transparent or translucent materials. The inner and outer forms may have the same or different cross sections. The decorative filler materials may be provided in conjunction with the article as part of a kit, in which case the amount of filler material is matched to the volume of the cavity by way of an initial pouring in to the cavity, for example.

BRIEF DESCRIPTION OF THE DRAWINGS

FIG. 10B is an oblique view of the votive candle vase of FIG. 10A;

FIG. 10C is a side view of the votive candle vase of FIG. 10A;

FIG. 11B is an oblique view of the tea light vase of FIG. 11A;

FIG. 11C is a side view of the tea light vase of FIG. 11A;

FIG. 11D is a top view of the tea light vase of FIG. 11A;

FIG. 11E is a bottom view of the tea light vase of FIG. 11A;

FIG. 13F is a bottom view of the tapered floral vase of FIG. 13C;

DETAILED DESCRIPTION OF THE INVENTION

Figure 1:
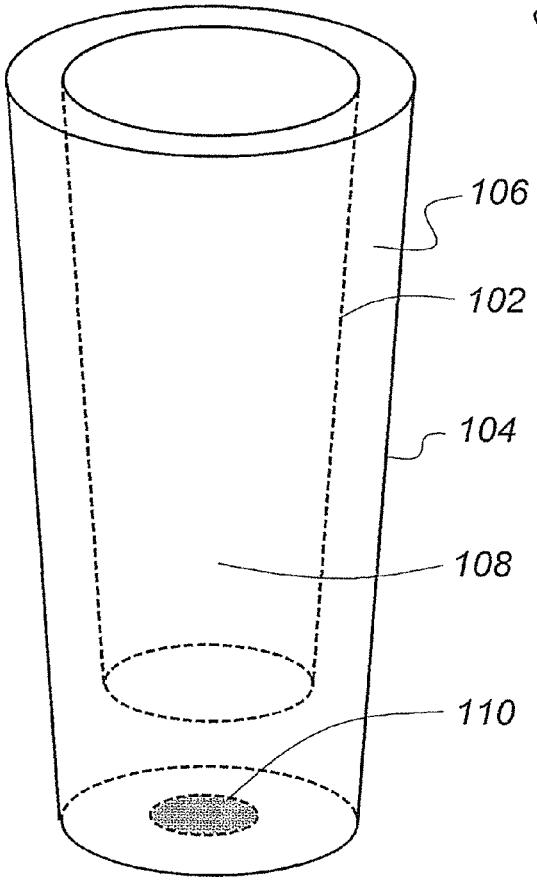
FIG. 1 illustrates a preferred embodiment of the invention.

This invention resides in double-walled articles and methods of making the same. The preferred embodiments include different shapes and sizes of flower vases and candle holders. FIG. 1 is a drawing of an embodiment of the invention. All embodiments include an aperture formed on a lower surface for gaining access to the space between the double walls. This enables the articles according to this invention to be filled with decorative filler materials that do not interfere with the candle or plant holding receptacles which may contain hot wax or water. In all embodiments a cap may be provided to seal off the aperture once the decorative filler materials have been introduced.

Figure 2:
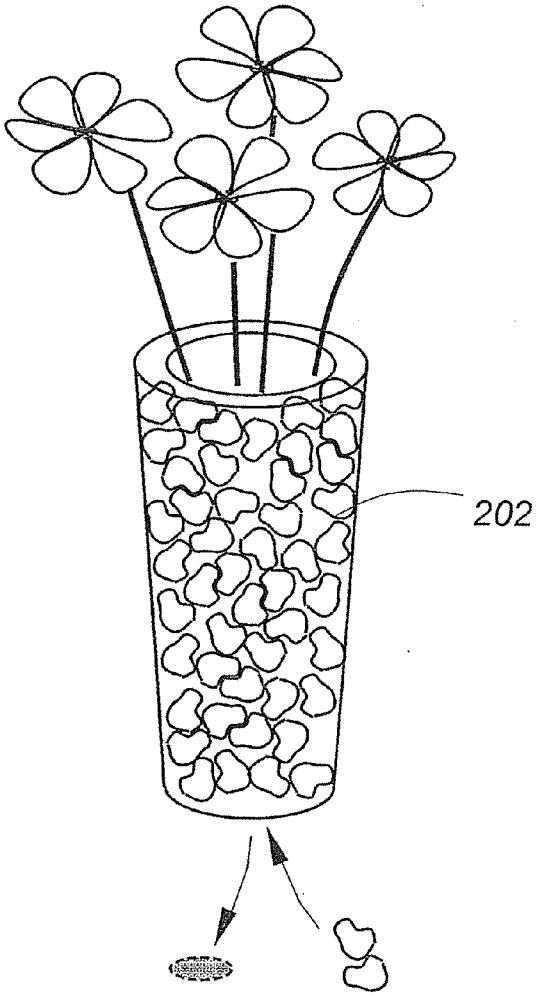
FIG. 2 shows the article of FIG. 1 with loaded filler material(s)

FIG. 1 illustrates a preferred embodiment of the invention. The article, preferably of glass, includes an inner wall 102, and an outer wall 104 creating a volume that may be filled with decorative materials 202 as shown in FIG. 2. Generally the article is turned upside, down as shown in FIGS. 15A-15F, or on its side to feed the filler materials into the volume 106. Such materials may include glass gems, glass pebbles, sea glass, decorative sands, decorative stones and pebbles, plastic gems and icons, wood, liquid and any other alternatives as long as the materials can be loaded through removable/replaceable plug 110. Inner wall 102 creates a vase 108 that may be filled with water, flowers, etc. Due to the way in which the article is constructed, the decorative accents do not contact with the contents of the vase 108.

Figure 3:
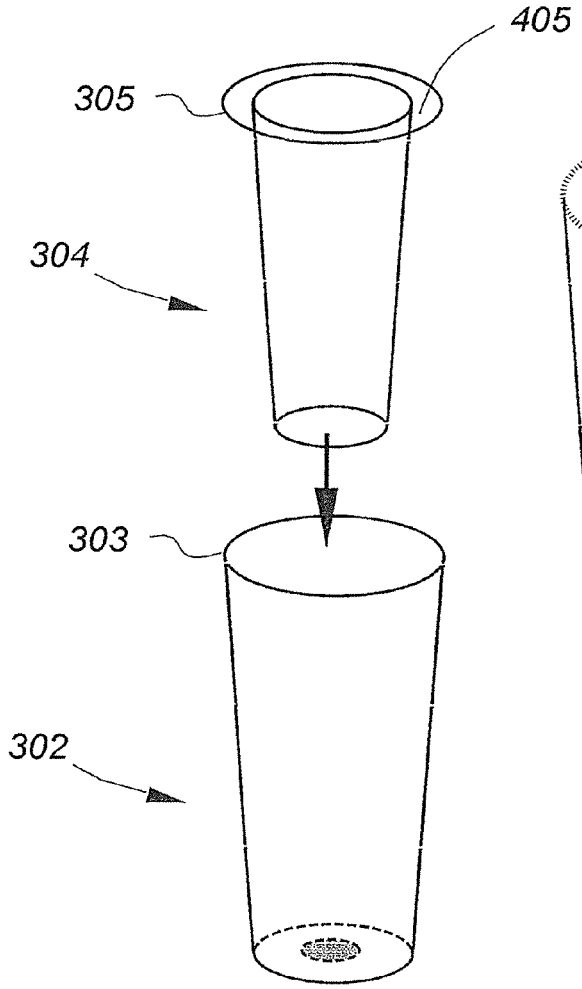
FIG. 3 depicts a two-piece, double-walled construction.

Articles according to the invention may be constructed entirely from pressed or blown glass, though such techniques may be expensive. As such, a two-piece construction may be used as shown in FIG. 3. This process involves an outer form 302 connected to an inner form 304. An advantage of this approach is that the inner and outer forms may be made of different colors of glass, or even different materials. For example, the outer form may be made of clear glass and the inner shape may be colored glass. Alternatively, the inner shape may be made of plastic or metal, with the outer shape being made of glass or plastic.

Figure 4:
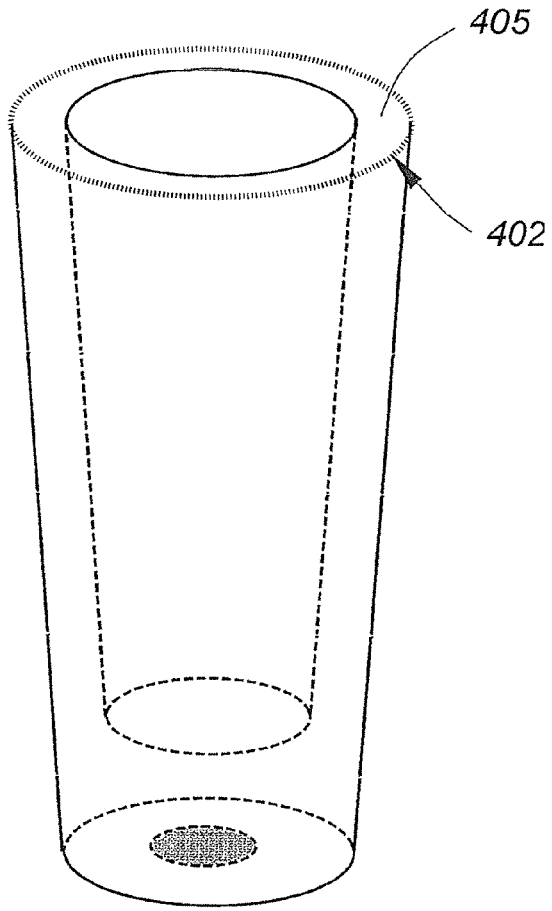
FIG. 4 shows the edge associated with joining the inner and outer forms of FIG. 3.

In FIG. 3, outer form 302 includes an upper edge 303 that is joined to an edge 305 of inner foul). 304. Inner form 304 may include a formed lip 405 enabling filler material to occupy volume 106 further up the completed article. FIG. 4 shows the edge 402 associated with joining the inner and outer forms 304, 302. If both forms are of glass such as borosilicate glass, interface 402 may be formed and closed with a torch. If different glasses or other materials are used, interface 402 may be made with a suitable bonding agent, including ultraviolet-cured adhesives.

Figure 5:
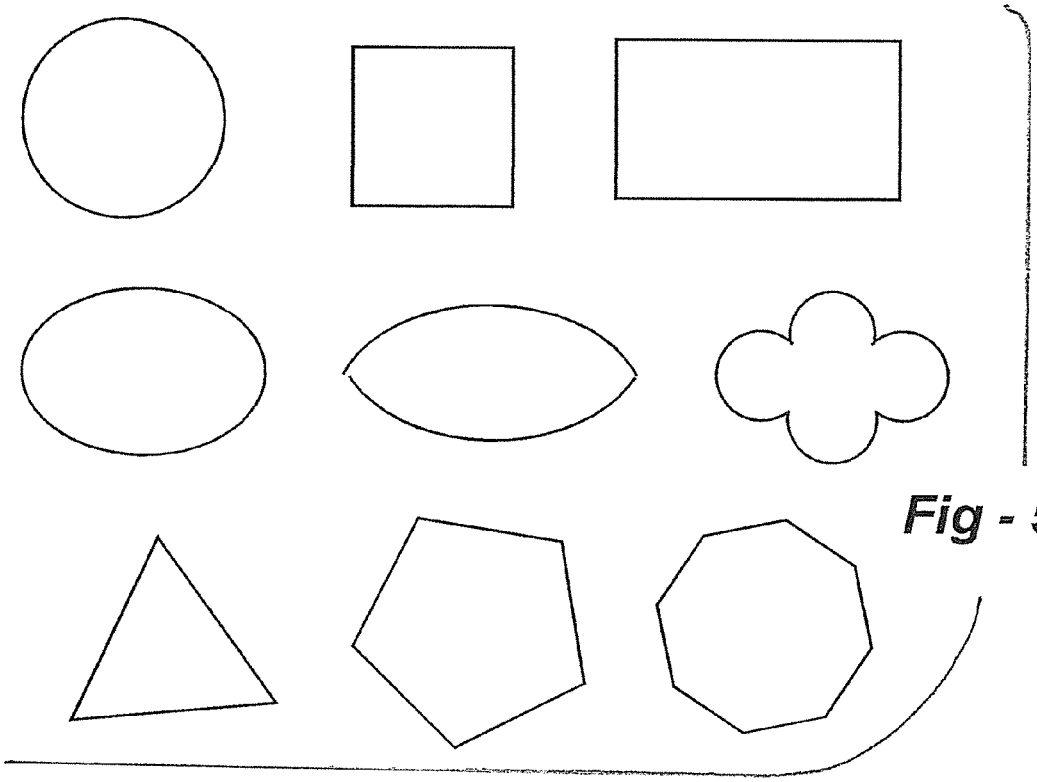
FIG. 5 shows various cross sections applicable to either the inner or the outer forms.
Figure 6:
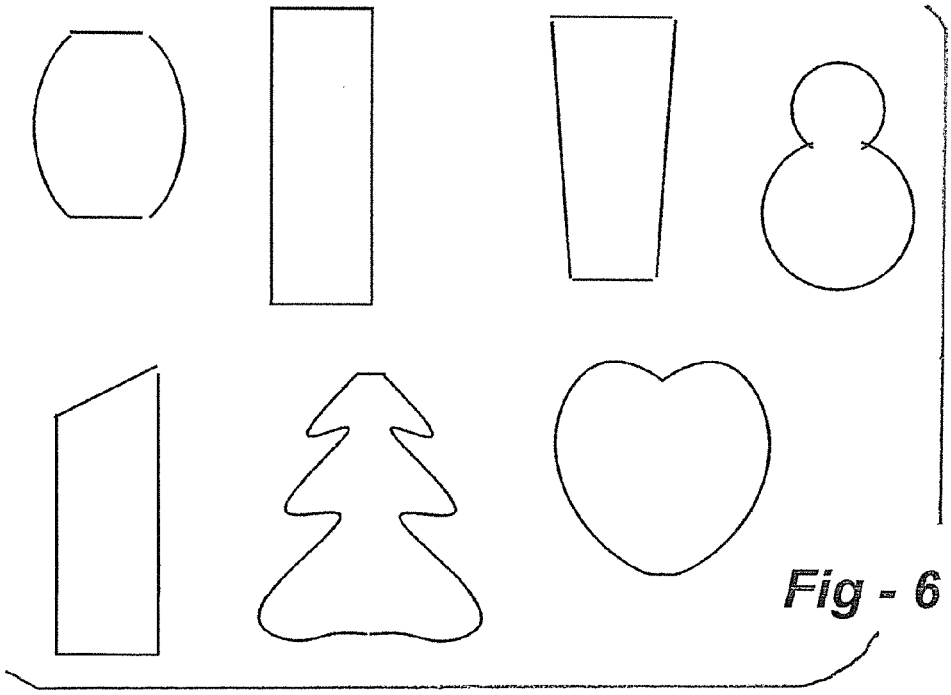
FIG. 6 presents side views that may be used for at least the outer form.
Figure 7:
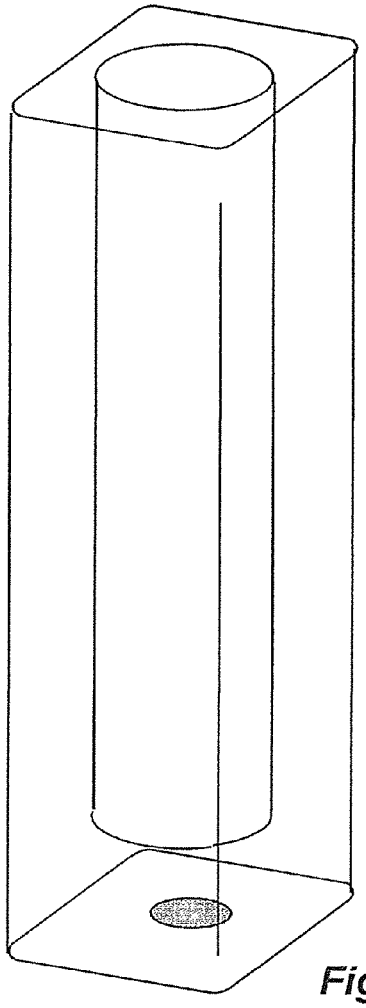
FIG. 7 shows how a square outer shape may be combined with with a cylindrical inner form.
Figure 8:
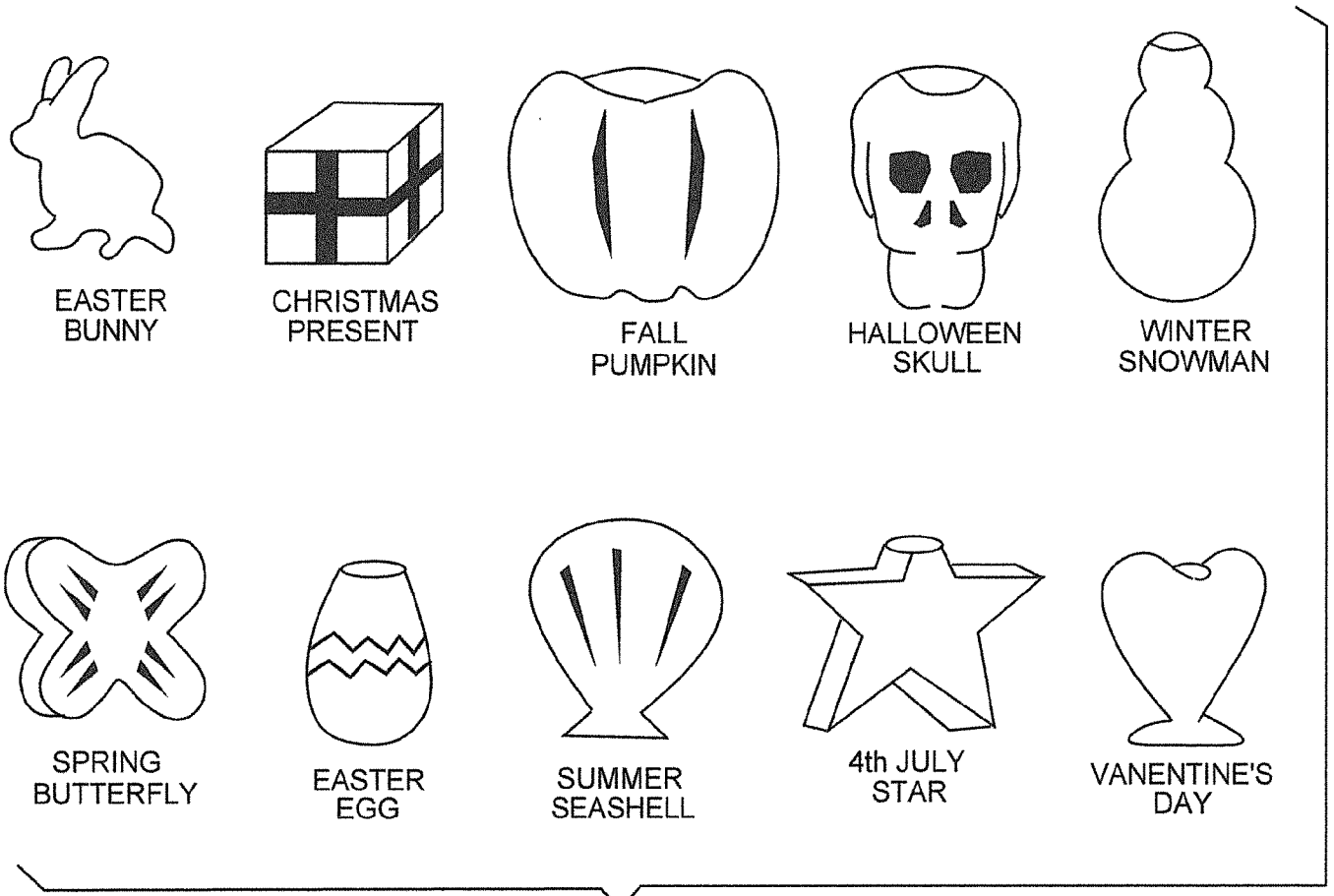
FIG. 8 illustrates other possible form and shape combinations.

While FIGS. 1-4 show conical inner and outer forms, different shapes may be mixed and matched. FIG. 5 shows various cross sections applicable to either the inner or the outer forms. FIG. 6 shows side views that may be used for either form. FIG. 7 shows, for example, a square outer shape with a cylindrical inner shape. A myriad other combinations are possible. FIG. 8, for example, illustrates outer shapes directed to holidays, and the like. In each case, a simpler inner form such as a cylindrical cup is used to hold flowers, candles, etc. Although not apparent in FIG. 8 the bottom of each form further includes a port and cap to receive and retain filler material(s).

Figure 9:
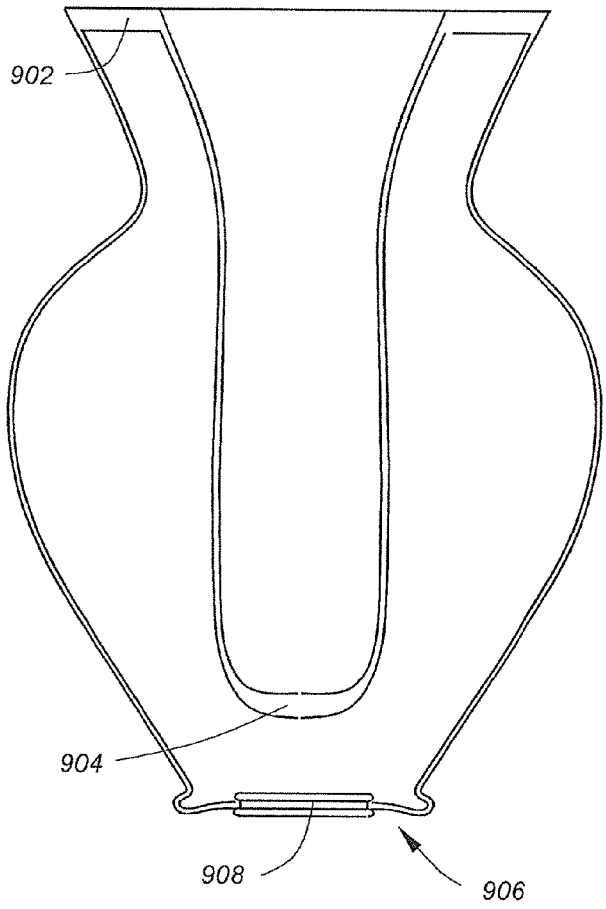
FIG. 9 illustrates options that may be desirable is some instances.

FIG. 9 illustrates options that may be desirable is some instances. For example, areas 902, 904 may be strengthened or fortified against filler materials striking these areas during filling. Further, a central portion of the bottom 906 may be recessed so that plug 908, typically made of plastic or rubber, does not extend outwardly from the bottom, which may lead to instability. A double-walled vase and filler material may be provided in a kit form, in which case the volume of the cavity between the inner and out walls may be measured (with water, for example), enabling a precise amount of filler material to be provided in the kit to fill the cavity to a desired level, including full, ⅔ full, half full, and so forth.

Figure 10A:
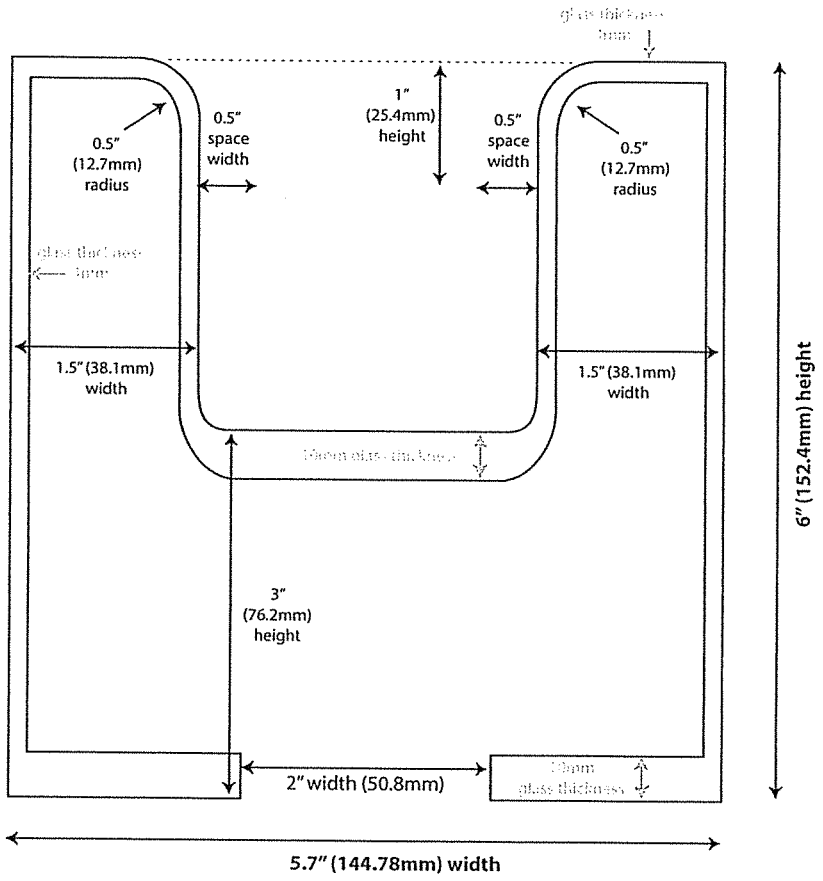
FIG. 10A is a cross section of a votive candle vase constructed in accordance with the invention including a set of preferred dimensions.
Figure 10A:
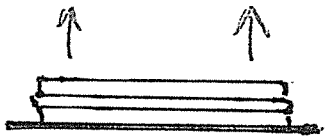
Figure 10D:
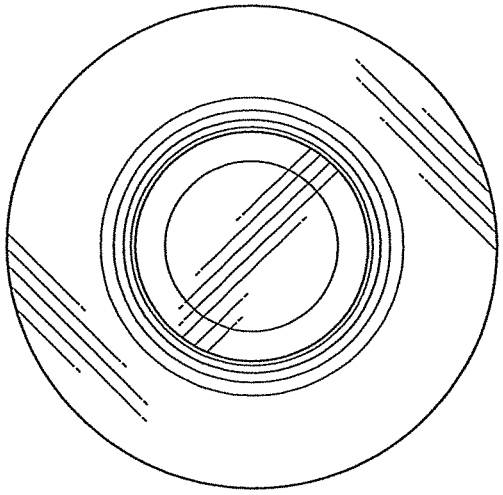
FIG. 10D is a top view of the votive candle vase of FIG. 10A.
Figure 10E:
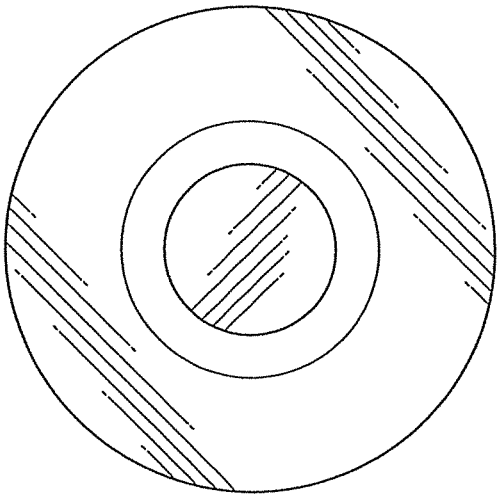
FIG. 10E is a bottom view of the votive candle vase of FIG. 10A.

FIG. 10A is a cross section of a votive candle vase constructed in accordance with the invention including a set of preferred dimensions. FIG. 10B is an oblique view of the votive candle vase of FIG. 10A; FIG. 10C is a side view, FIG. 10D is a top view, and FIG. 10E is a bottom view.

Figure 11A:
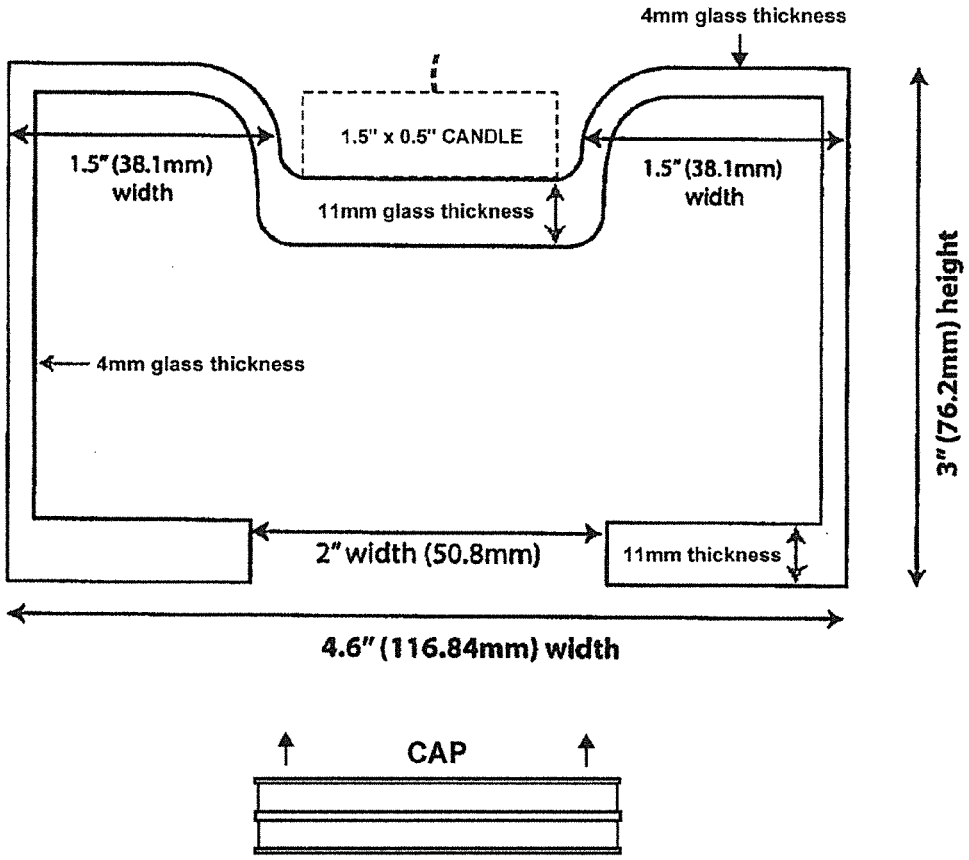
FIG. 11A is a cross section of a tea light vase constructed in accordance with the invention including a set of preferred dimensions.

FIG. 11A is a cross section of a tea light vase constructed in accordance with the invention including a set of preferred dimensions. FIG. 11B is an oblique view of the tea light vase of FIG. 11A; FIG. 11C is a side view, FIG. 11D is a top view, and FIG. 11E is a bottom view.

Figure 12A:
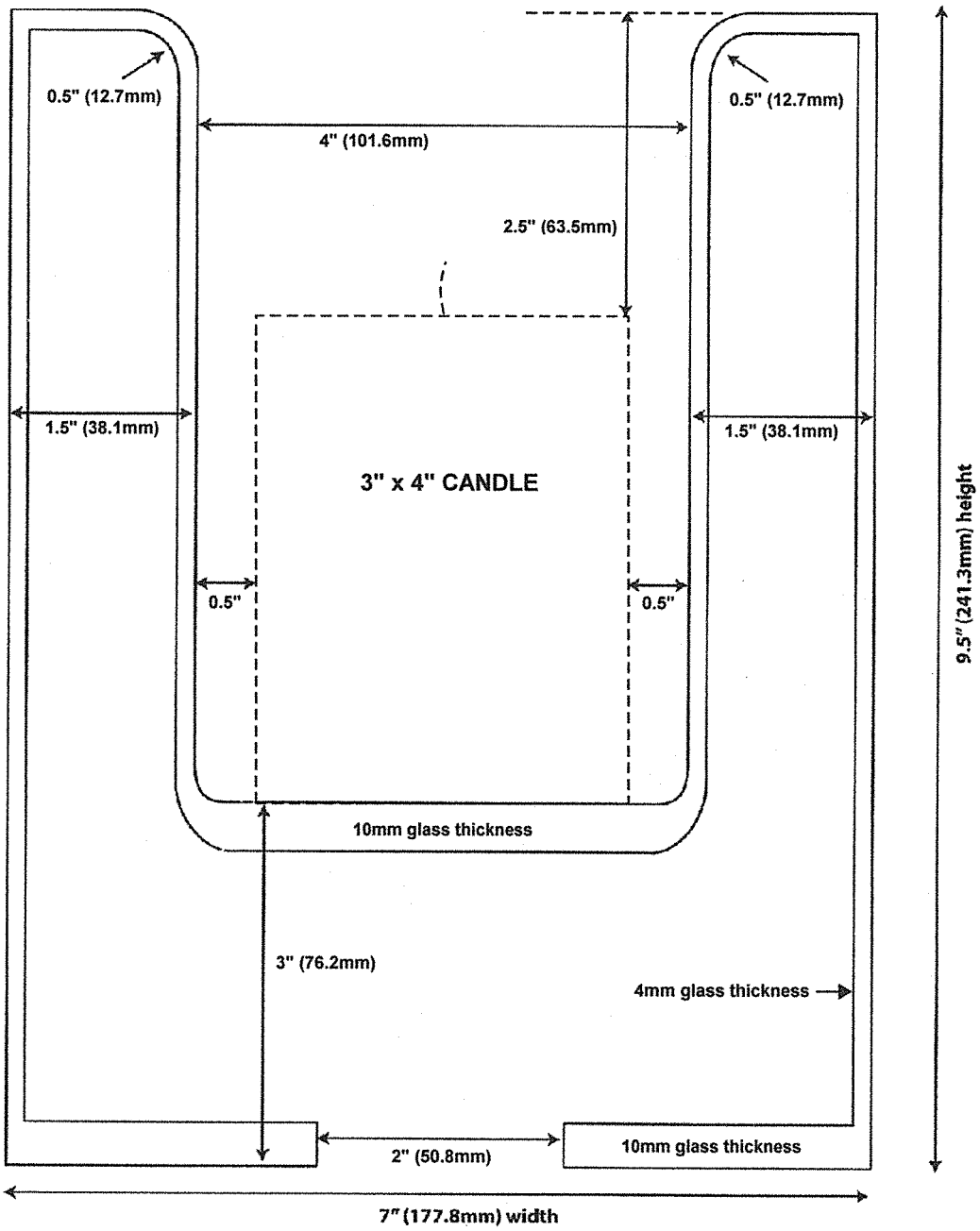
FIG. 12A is a cross section of a standard pillar vase constructed in accordance with the invention including a set of preferred dimensions.
Figure 12B:
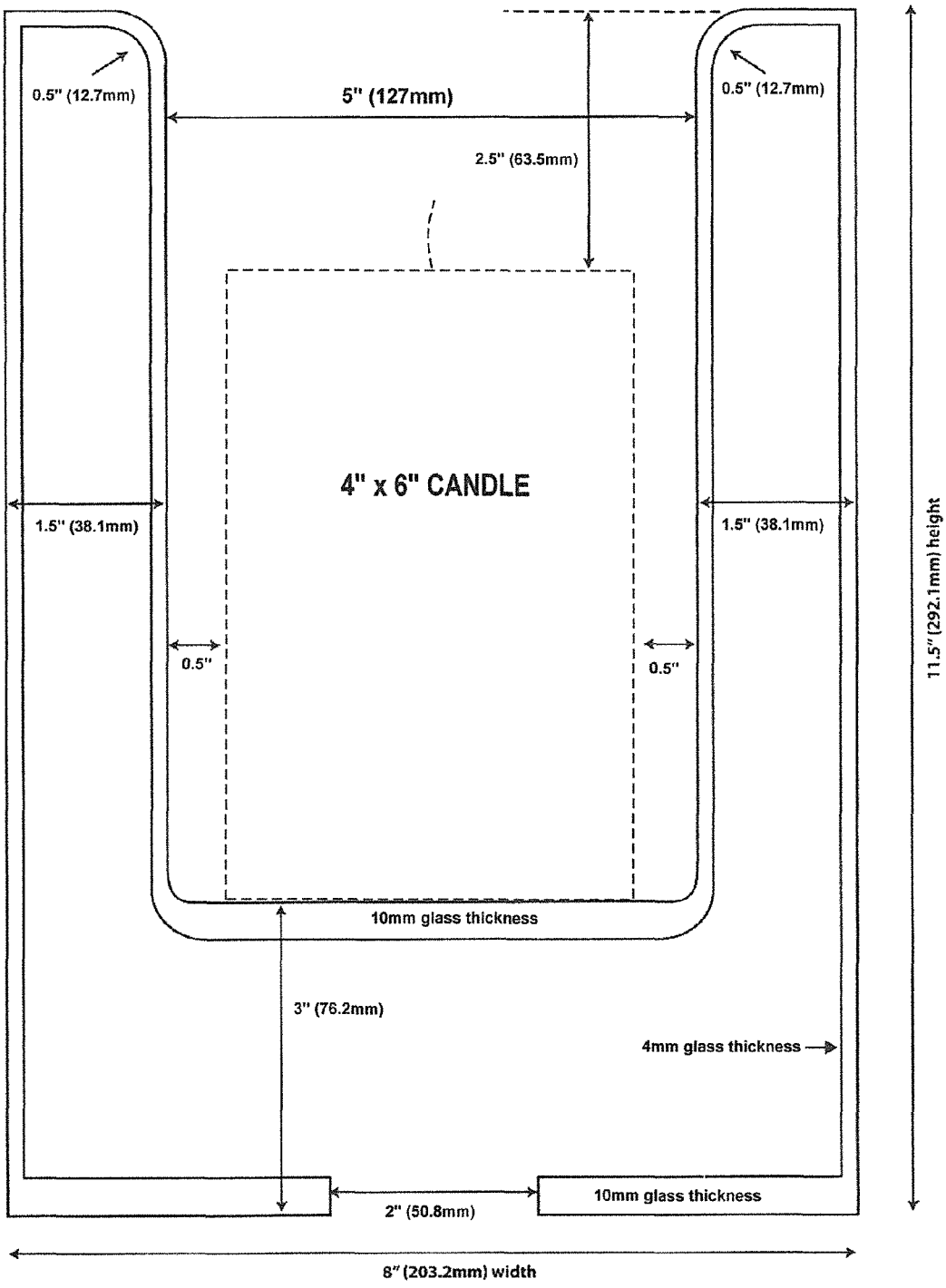
FIG. 12B is a cross section of a tall pillar vase constructed in accordance with the invention including a set of preferred dimensions.
Figure 12C:
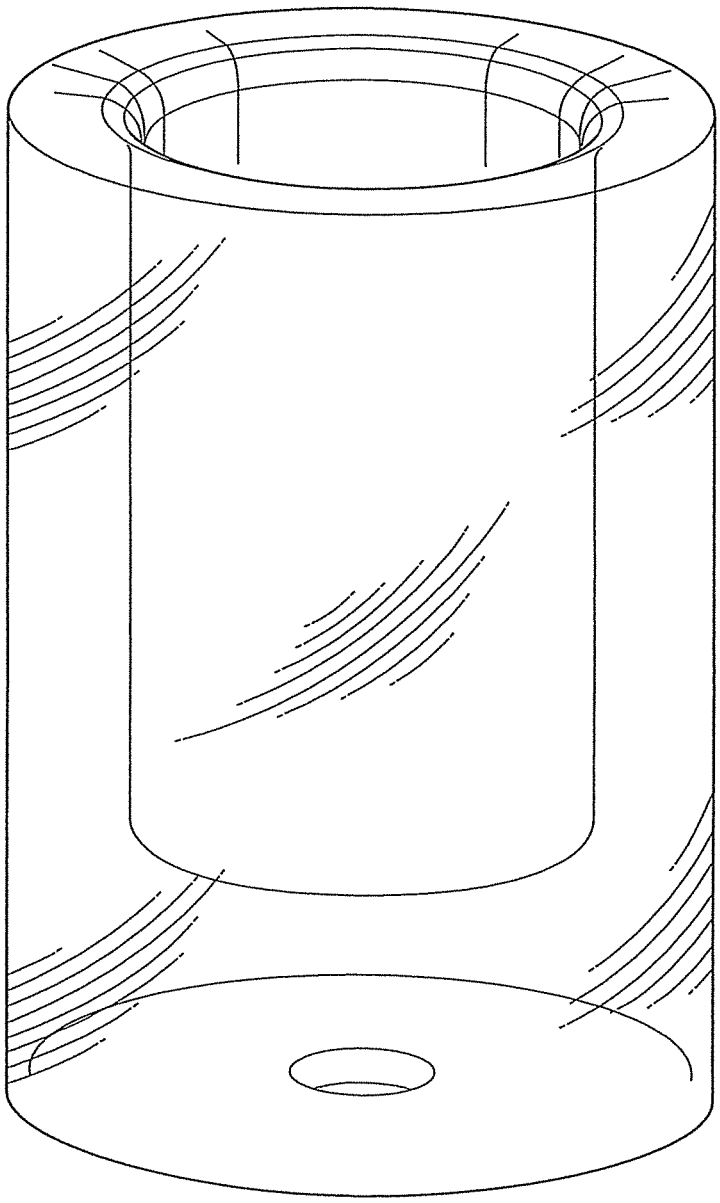
FIG. 12C is an oblique view of a pillar vase.
Figure 12D:
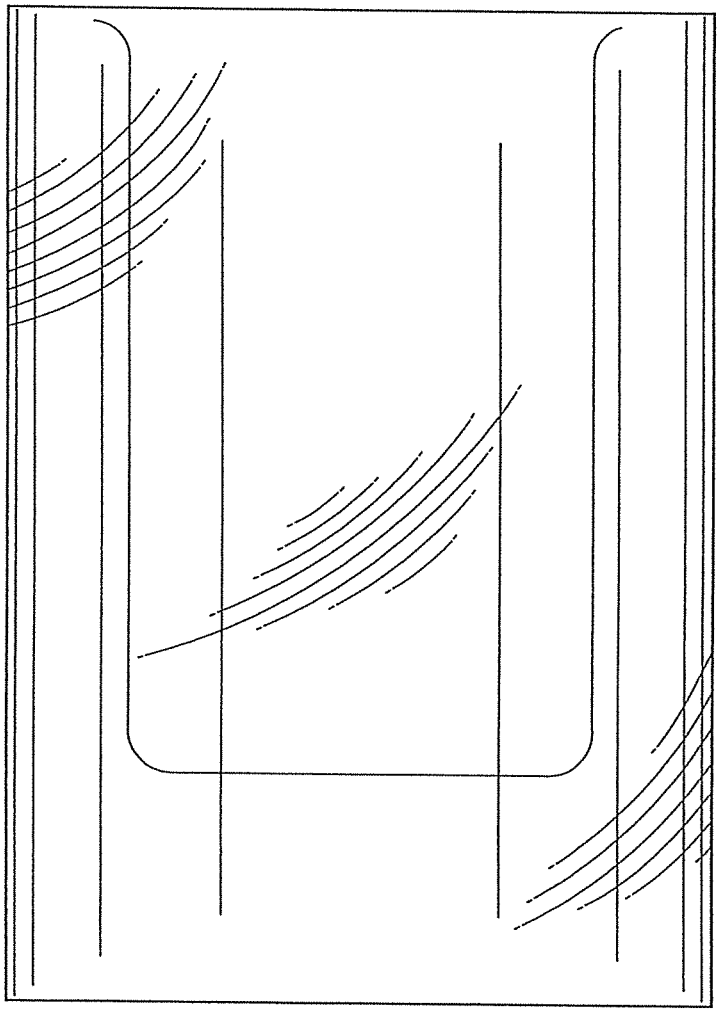
FIG. 12D is a side view of the pillar vase of FIG. 12C.
Figure 12E:
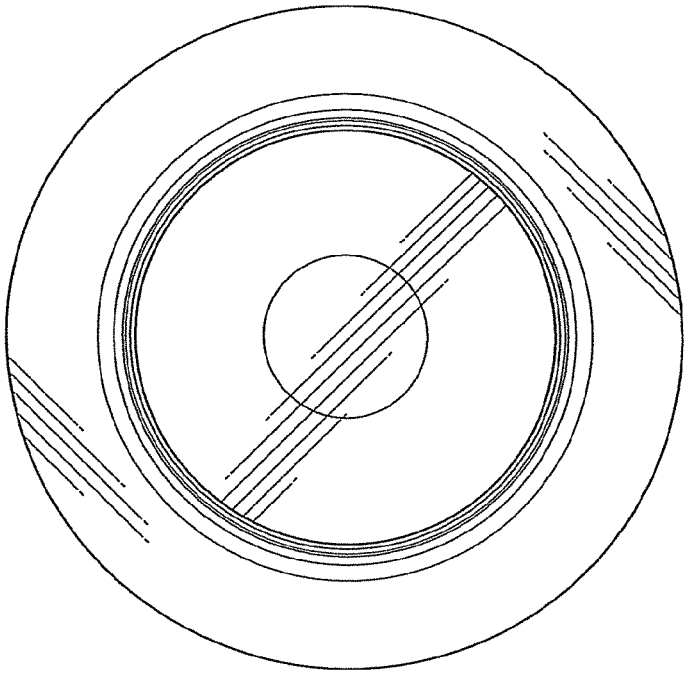
FIG. 12E is a top view of the pillar vase of FIG. 12C.
Figure 12F:
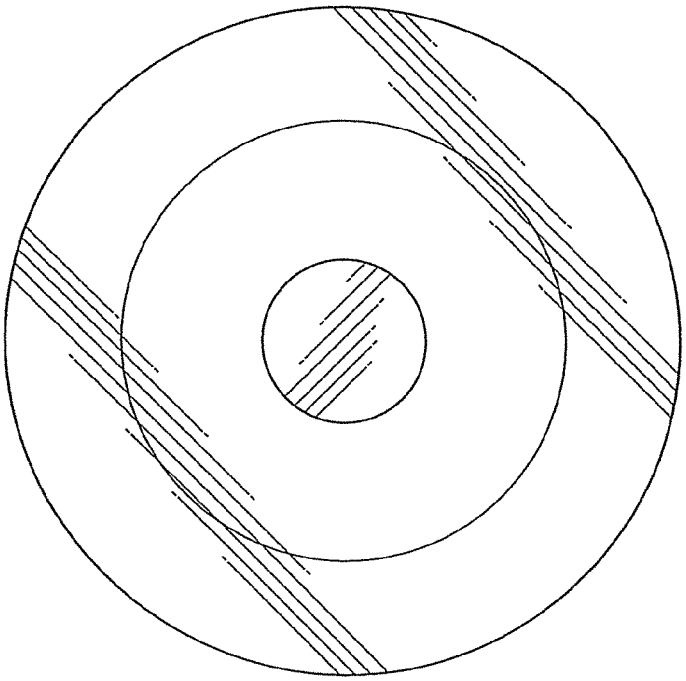
FIG. 12F is a bottom view of the pillar vase of FIG. 12C.

FIG. 12A is a cross section of a standard pillar vase constructed in accordance with the invention including a set of preferred dimensions. FIG. 12B is a cross section of a tall pillar vase constructed in accordance with the invention including a set of preferred dimensions. FIG. 12C is an oblique view of a pillar vase; FIG. 12D is a side view, FIG. 12E is a top view, and FIG. 12F is a bottom view.

Figure 13A:
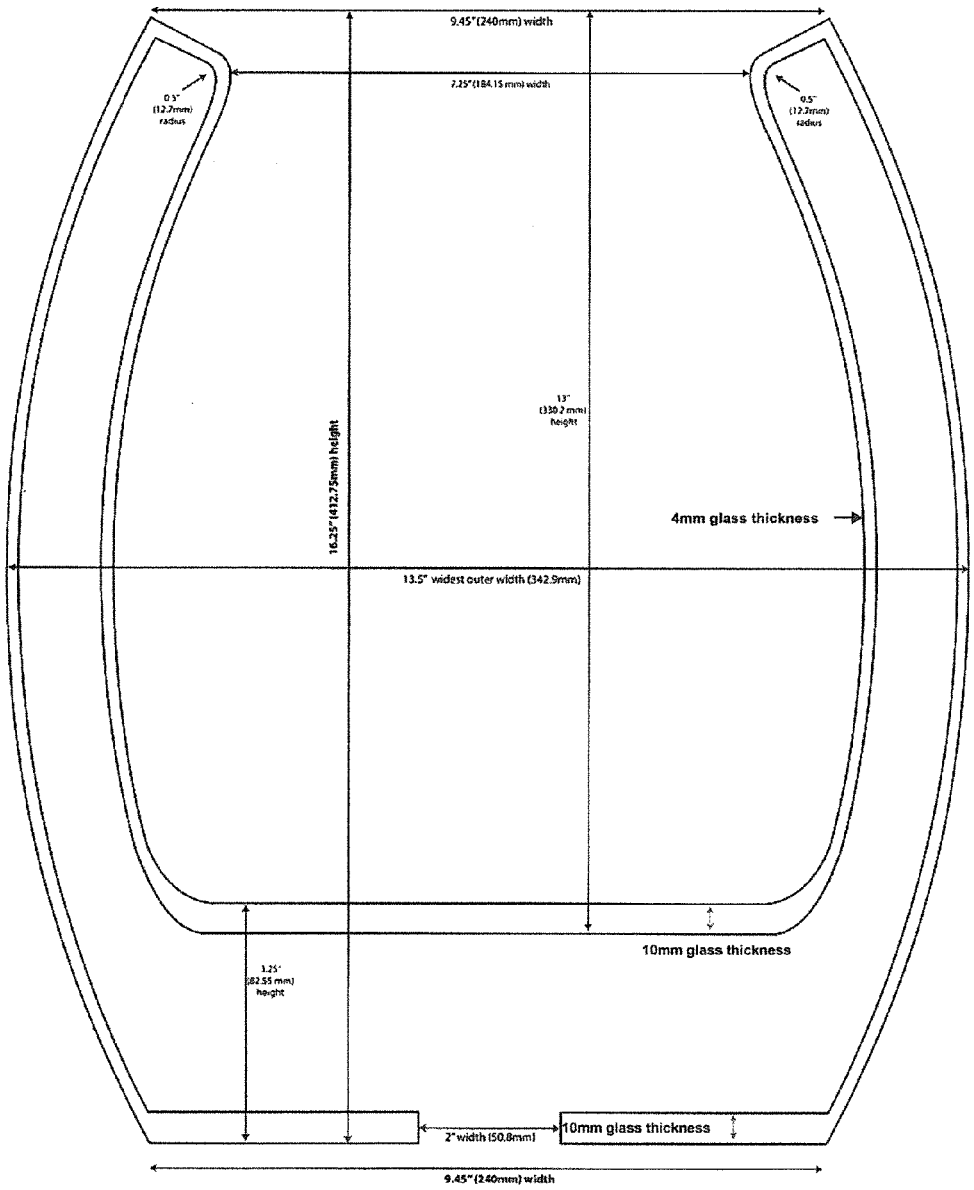
FIG. 13A is a cross section of a large tapered floral vase constructed in accordance with the invention including a set of preferred dimensions.
Figure 13B:
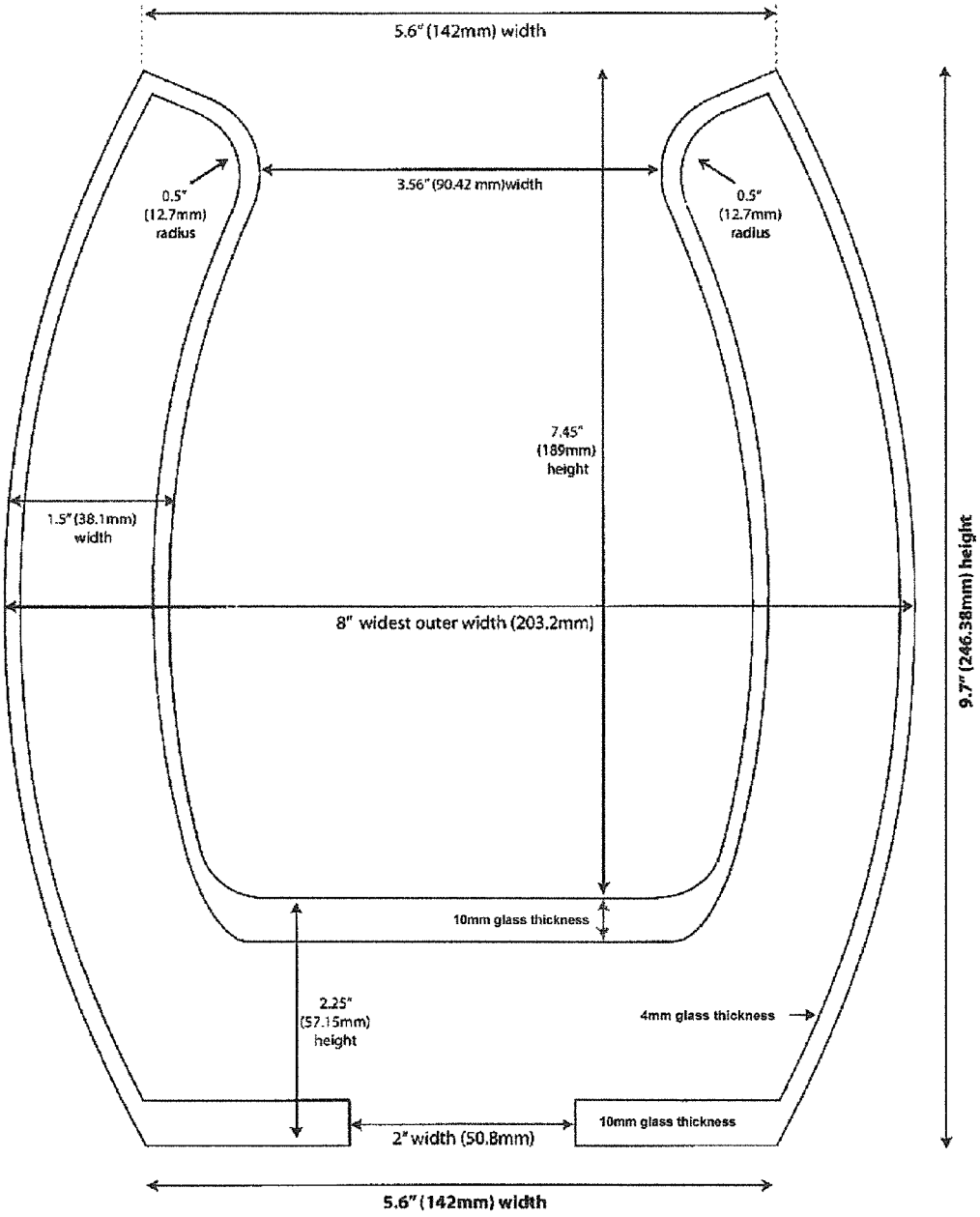
FIG. 13B is a cross section of a standard tapered floral vase constructed in accordance with the invention including a set of preferred dimensions.
Figure 13C:
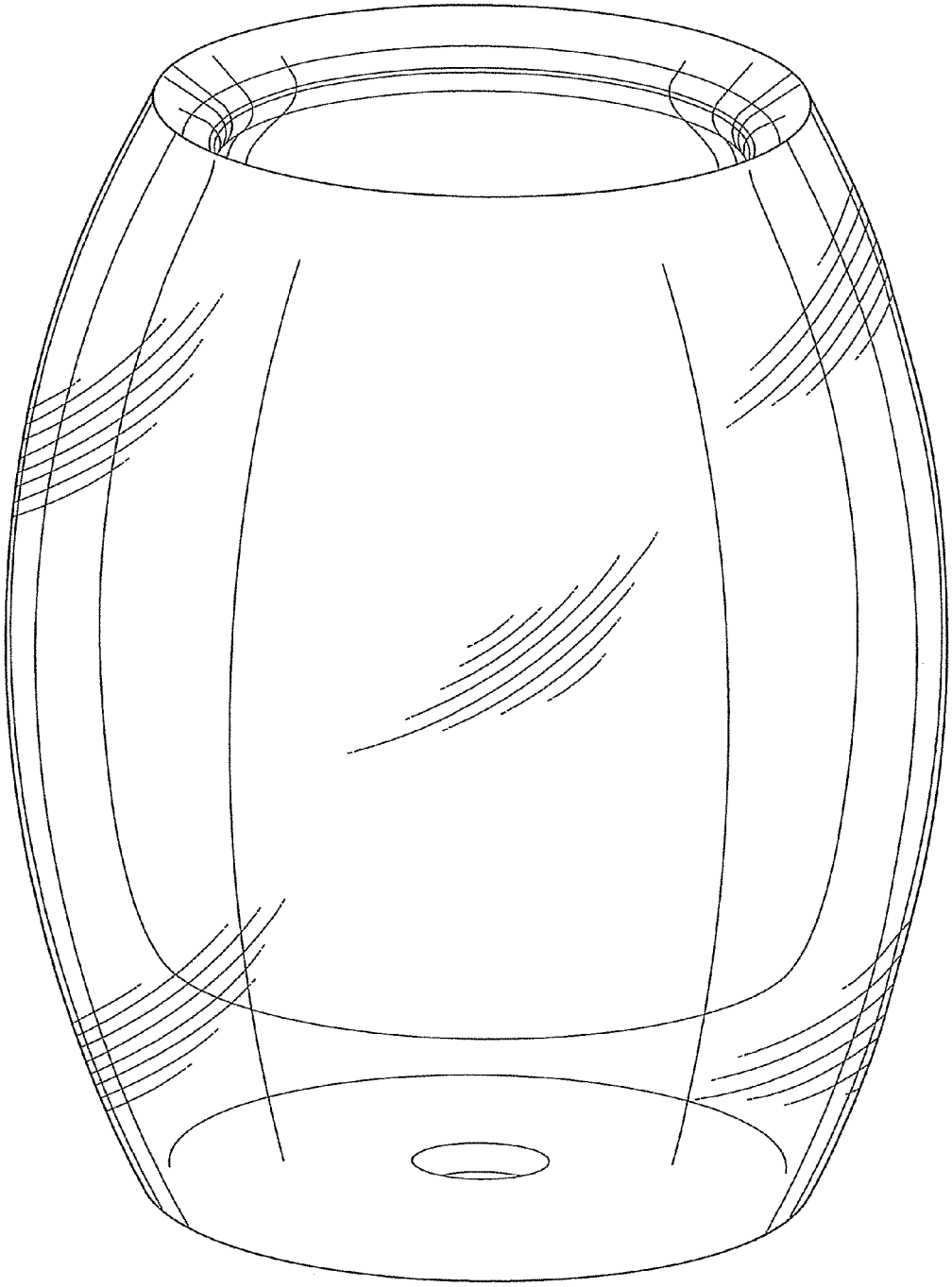
FIG. 13C is an oblique view of a tapered floral vase.
Figure 13D:
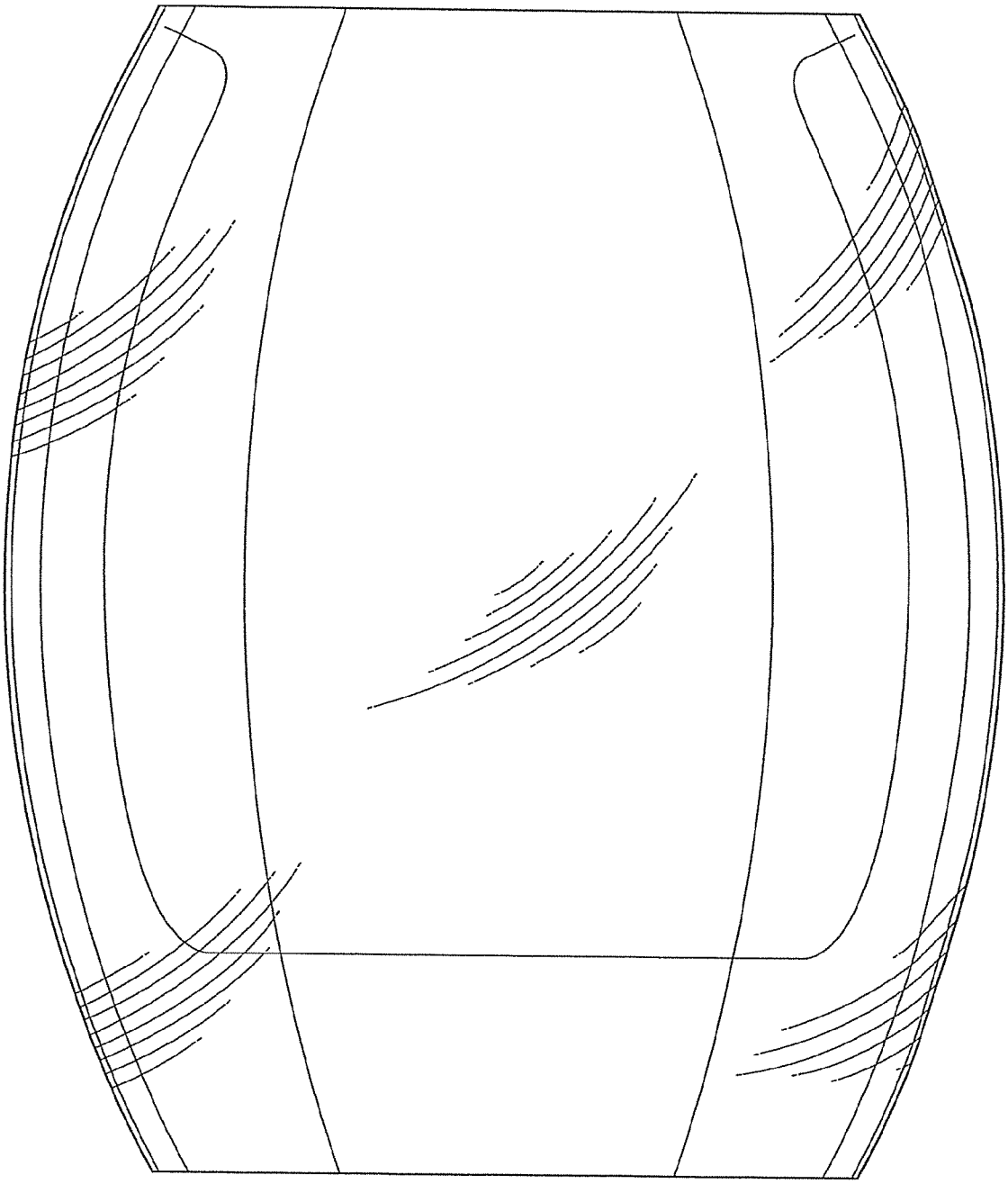
FIG. 13D is a side view of the tapered floral vase of FIG. 13C.
Figure 13E:
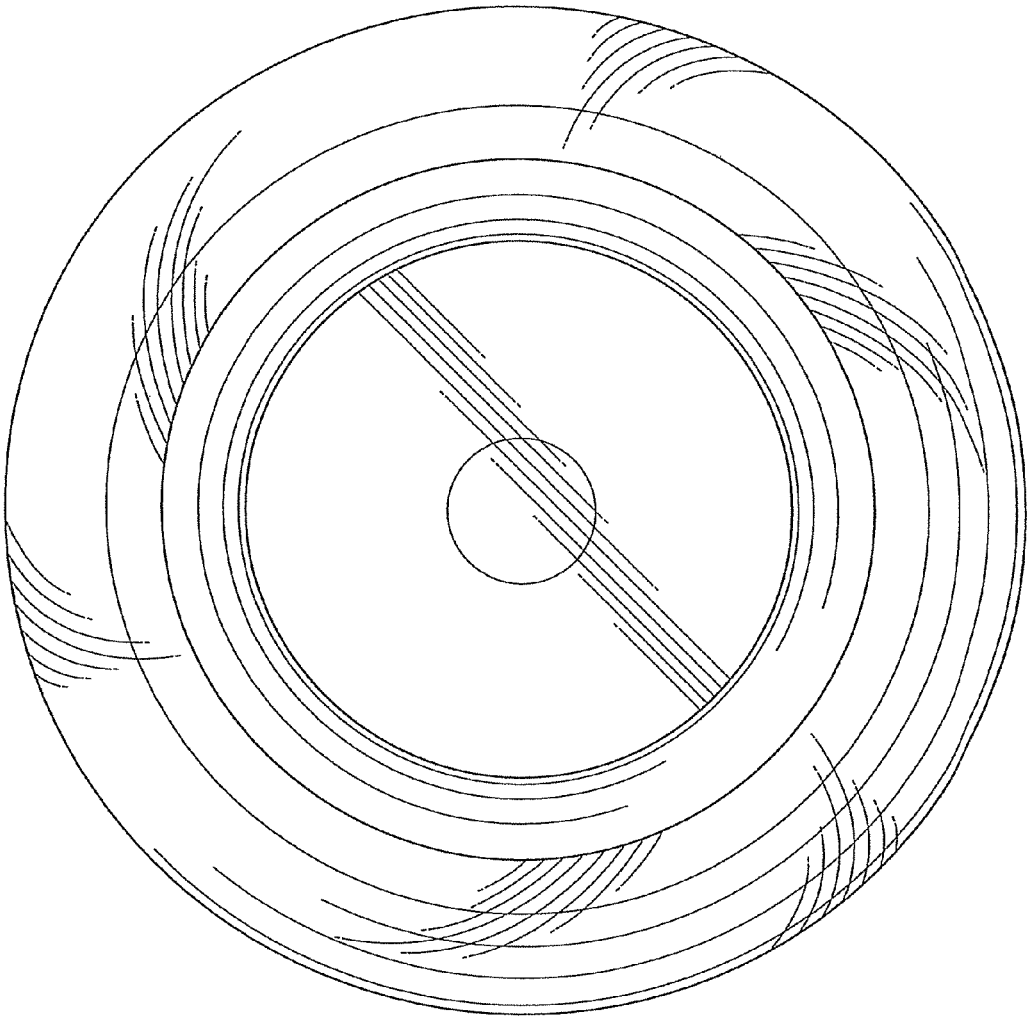
FIG. 13E is a top view of the tapered floral vase of FIG. 13C.

FIG. 13A is a cross section of a large tapered floral vase constructed in accordance with the invention including a set of preferred dimensions. FIG. 13B is a cross section of a standard tapered floral vase constructed in accordance with the invention including a set of preferred dimensions. FIG. 13C is an oblique view of a tapered floral vase, FIG. 13D is a side view, FIG. 13E is a top view, and FIG. 13F is a bottom view.

Figure 14A:
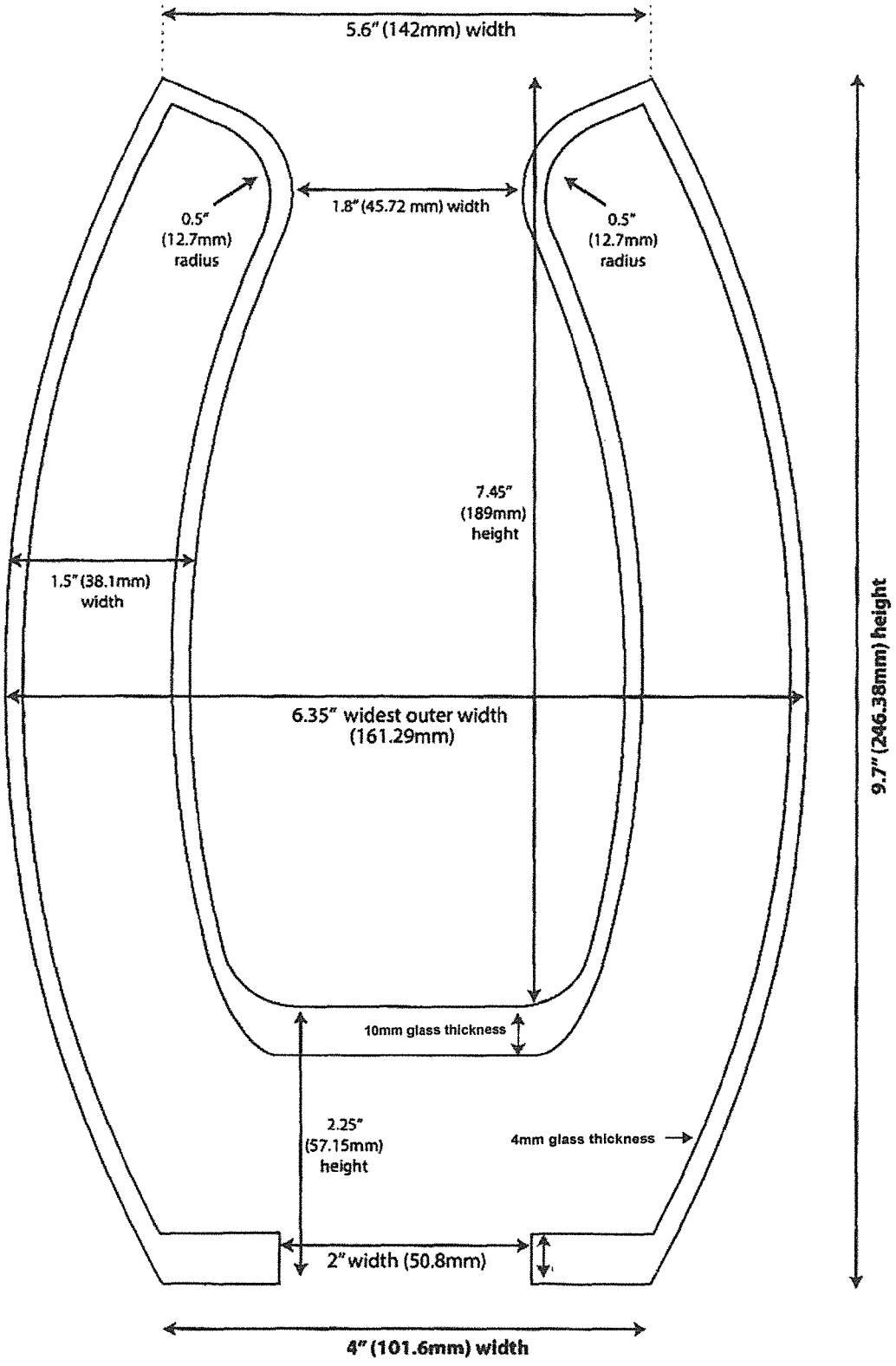
FIG. 14A is a cross section of a floral bud vase constructed in accordance with the invention including a set of preferred dimensions.
Figure 14B:
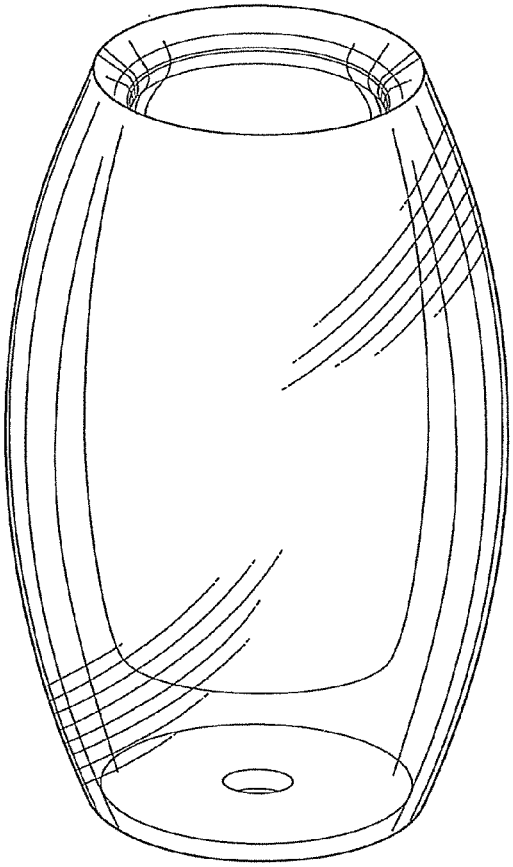
FIG. 14B is an oblique view of the floral bud vase of FIG. 14A.
Figure 14C:
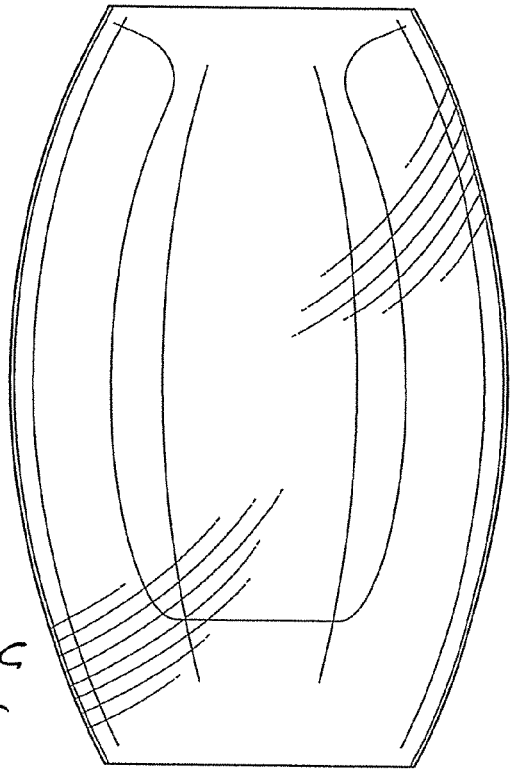
FIG. 14C is a side view of the floral bud vase of FIG. 14A.
Figure 14D:
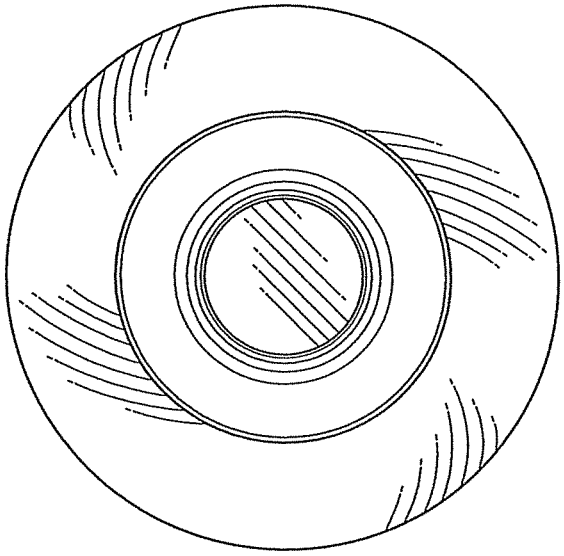
FIG. 14D is a top view of the floral bud vase of FIG. 14A.
Figure 14E:
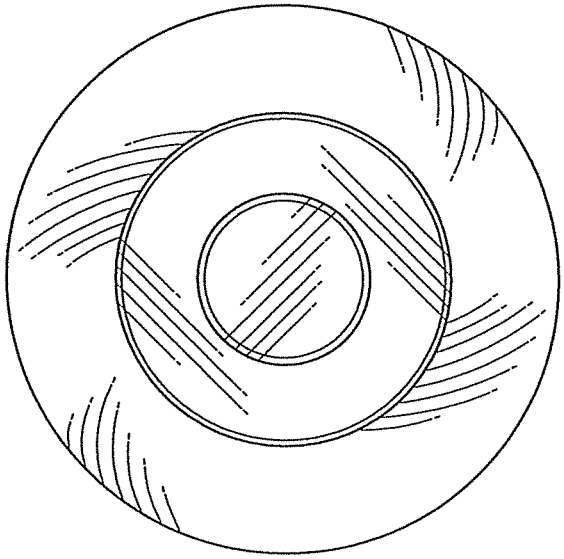
FIG. 14E is a bottom view of the floral bud vase of FIG. 14A.
Figure 15:
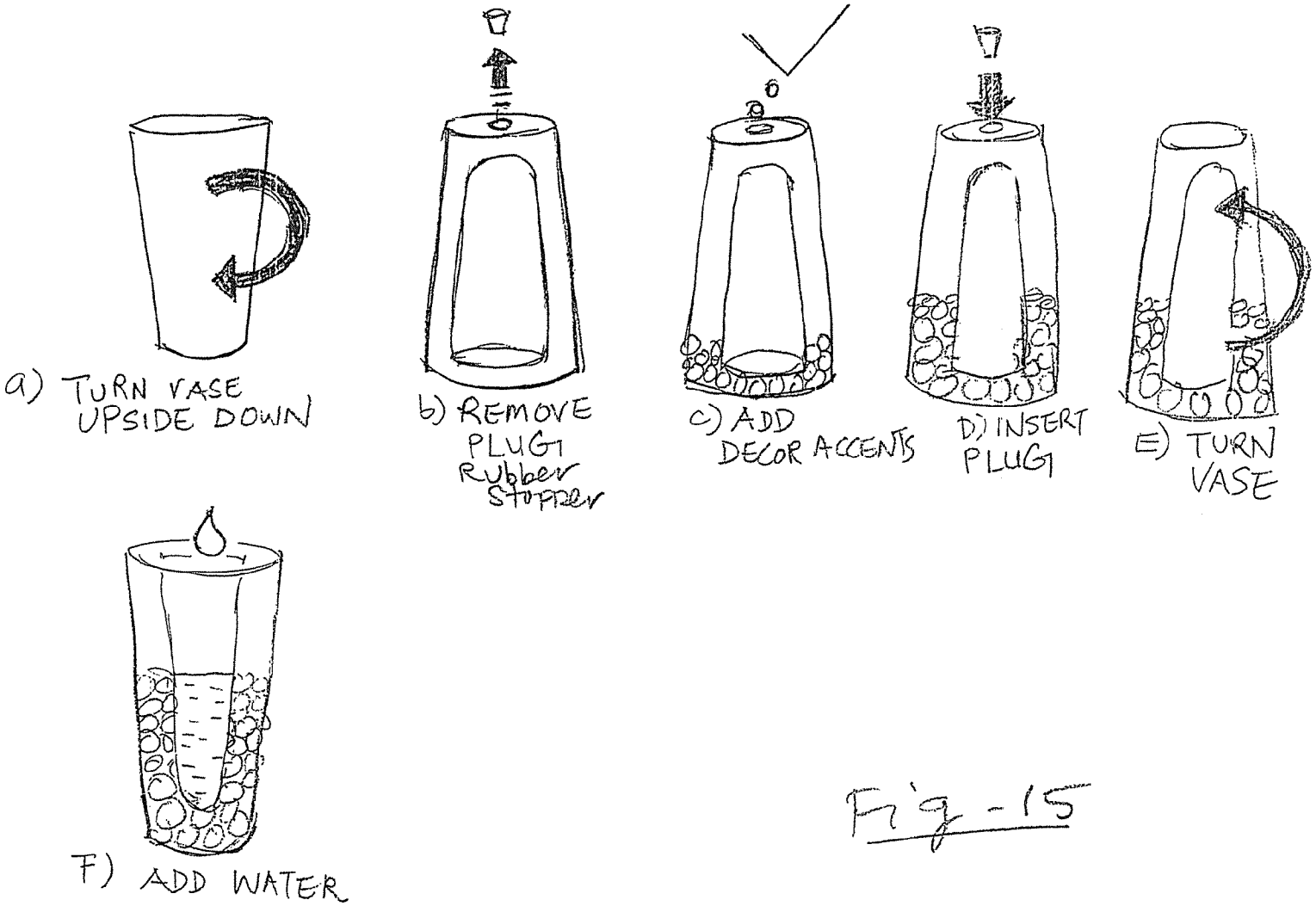

FIG. 14A is a cross section of a floral bud vase constructed in accordance with the invention including a set of preferred dimensions. FIG. 14B is an oblique view of the floral bud vase of FIG. 14A; FIG. 14C is a side view, FIG. 14D is a top view, and FIG. 14E is a bottom view.

Figure 15F:
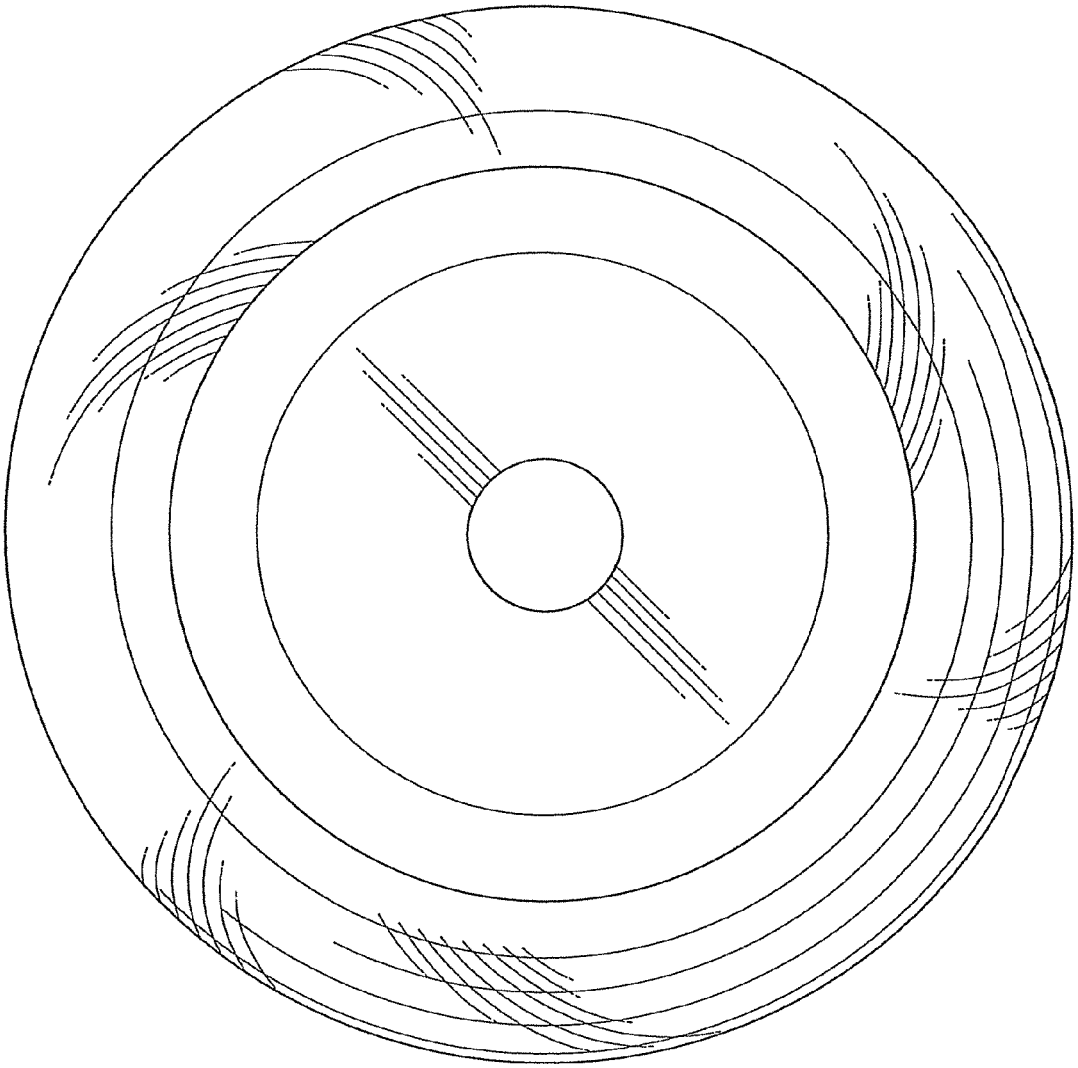
FIGS. 15A-15F show the way in which an article according to the invention may be turned upside down to receive filler material(s).

FIGS. 15A-15F show the way in which an article according to the invention may be turned upside down to receive filler material(s). FIG. 15A shows the article being turned upside down. FIG. 15B shows the plug or stopper being removed. FIG. 15C illustrates decorative accents being added to the volume between the inner and outer forms. FIG. 15D shows the plug being re-inserted. The article is turned over at FIG. 15E, and water (or candles or other substances) are added at FIG. 15F.

The invention claimed is:

1. A decorative article, comprising:

an inner form defining a receptacle having a sidewall with an inner surface, an outer surface and a thickness, and a bottom wall with an inner surface, an outer surface and a thickness;

an outer form having a sidewall with an inner surface, an outer surface and a thickness, and a bottom wall with an inner surface, an outer surface and a thickness, the outer form being spaced apart from the inner form to create a cavity between the outer surface of the inner form and the inner surface of the outer form;

a bottom opening in the outer form enabling solid decorative filler materials to be introduced through the cavity such that the decorative materials do not enter into the receptacle;

wherein the thickness of the bottom wall of the inner form is thicker than the thickness of the sidewall of the inner form to minimize breakage of the inner form as solid decorative filler materials are introduced through the bottom opening; and a removably replaceable plug or cap to close off the bottom opening following the introduction of the decorative filler materials.

2. The decorative article of claim 1, wherein the inner and outer forms are provided as separate pieces and are joined.

3. The decorative article of claim 1, wherein the inner and outer forms are made of glass.

4. The decorative article of claim 1, wherein the inner and outer forms have the same or different cross sections.

5. The decorative article of claim 1, including the decorative filler materials as part of a kit.

6. The decorative article of claim 1, including:

the decorative filler materials as part of a kit; and wherein the amount of filler material is matched to the volume of the cavity.

7. The decorative article of claim 1, wherein the cavity is thicker between the bottom walls of the inner and outer forms as compared to the sidewalls of the inner and outer forms to assist in the introduction of the solid decorative filler materials through the bottom opening.

* * * * *